US005722919A

United States Patent [19]

Timmer

[11] Patent Number: 5,722,919

[45] Date of Patent: Mar. 3, 1998

[54] ANKLE REHABILITATION AND CONDITIONING DEVICE

[76] Inventor: Kirk Timmer, 528 21st Ave. NE., Great Falls, Mont. 59404

[21] Appl. No.: 705,962

[22] Filed: Aug. 30, 1996

[51] Int. Cl.[6] ..... A63B 21/06; A63B 23/08

[52] U.S. Cl. ..... 482/79; 482/105; 482/146

[58] Field of Search ..... 482/79, 93, 105, 482/108, 109, 146, 51, 147, 148, 908

[56] References Cited

U.S. PATENT DOCUMENTS

| | | | |
|---|---|---|---|
| 1,990,970 | 2/1935 | Wood | 36/2.5 |
| 2,114,790 | 4/1938 | Venables . | |
| 2,214,052 | 9/1940 | Good | 482/105 |
| 2,642,286 | 6/1953 | LeRoy . | |
| 2,700,832 | 2/1955 | Slovinski | 36/8.5 |
| 2,733,065 | 1/1956 | Barkschat . | |
| 2,849,237 | 8/1958 | Simithis . | |
| 3,343,836 | 9/1967 | James, Jr. . | |
| 3,802,700 | 4/1974 | Mayo . | |
| 4,076,236 | 2/1978 | Ionel . | |
| 4,337,939 | 7/1982 | Hoyle et al. | 482/79 |
| 4,361,324 | 11/1982 | Baroi . | |
| 4,566,690 | 1/1986 | Schook . | |
| 4,653,748 | 3/1987 | Seel et al. | 482/146 |
| 4,743,018 | 5/1988 | Eckler | 482/908 X |
| 5,267,927 | 12/1993 | Catanzano et al. | 482/105 |

FOREIGN PATENT DOCUMENTS

| | | | |
|---|---|---|---|
| 1491589 | 11/1969 | Germany | 482/79 |
| 622320 | 4/1949 | United Kingdom | 482/109 |

OTHER PUBLICATIONS

Elgin Exercise Equipment Corp., brochure for "Elgin Leg/Ankle Exerciser", date unknown.

*Primary Examiner*—Richard J. Apley
*Assistant Examiner*—John Mulcahy
*Attorney, Agent, or Firm*—Harry M. Cross, Jr.

[57] ABSTRACT

An ankle strengthening and rehabilitation device comprises a foot plate attachable to the sole of a person's foot, and a weight attachable to the foot plate so as to cantilever outward from the bottom surface of the foot plate. The foot plate may be provided with an isolation channel extending along a longitudinal axis of the foot plate, and with a fastener for attaching the weight to the foot plate through the isolation channel so that the weight may be selectively positioned along the longitudinal axis of the foot plate. Alternately, the foot plate may be provided with a series of isolation apertures positioned along a longitudinal axis of the foot plate, and with a fastener for attaching the weight to the foot plate through any one of isolation apertures so that the weight may be selectively positioned along the longitudinal axis of the foot plate. The weight may comprise multiple weighted disks assembled together to form a weighted column. The weight may be replaced by a proprioception balance element that is adjustably positionable along the longitudinal axis of the foot plate.

13 Claims, 10 Drawing Sheets

FIG. 1
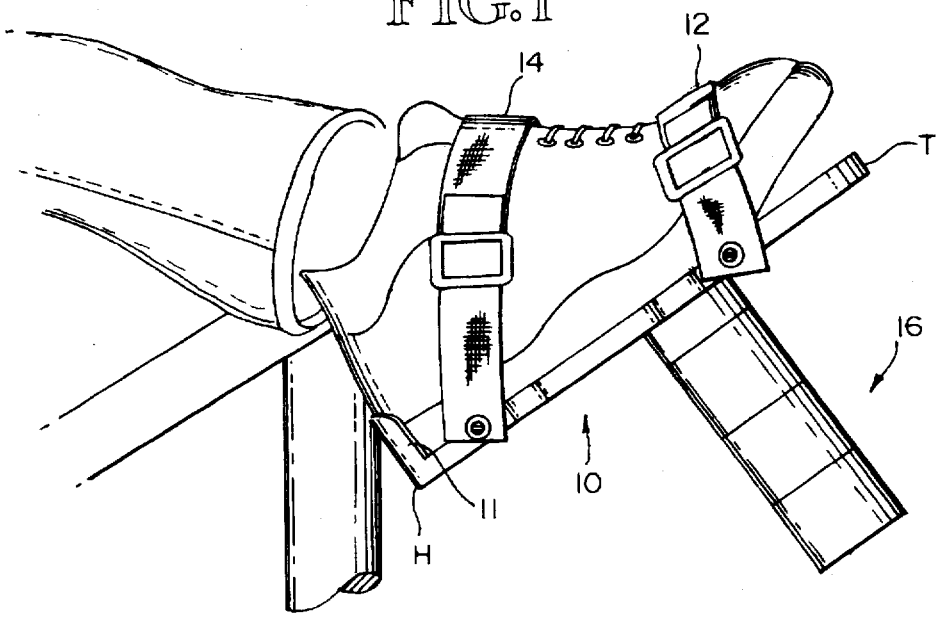
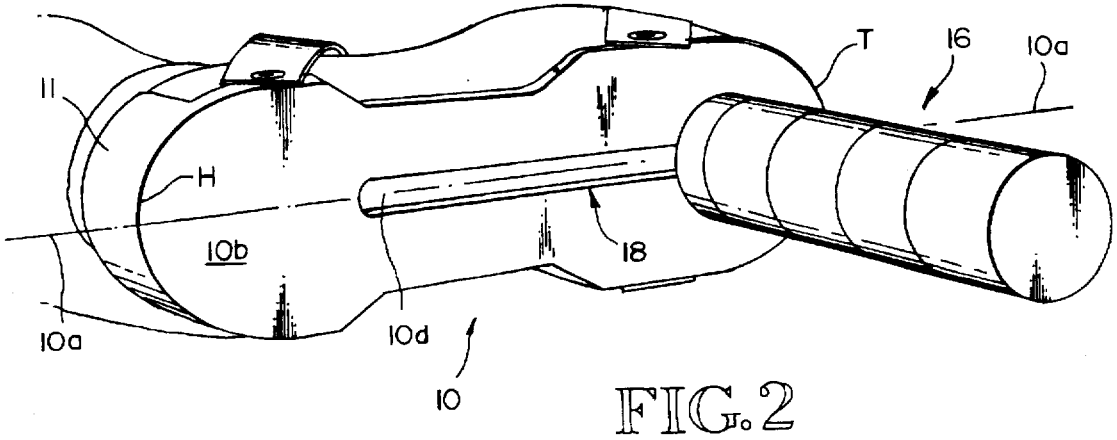
FIG. 2

FIG. 3
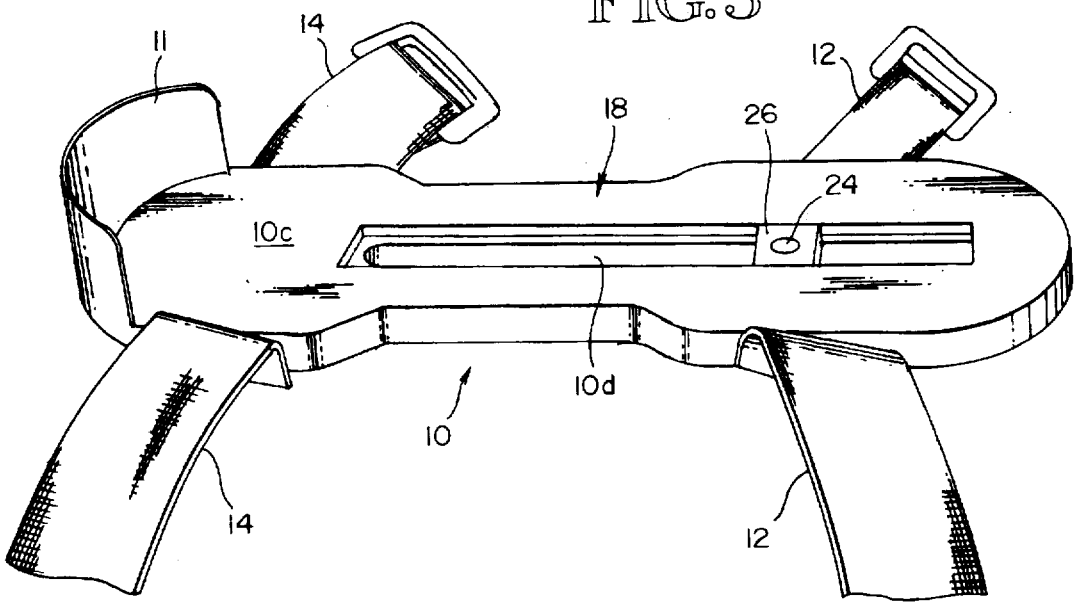
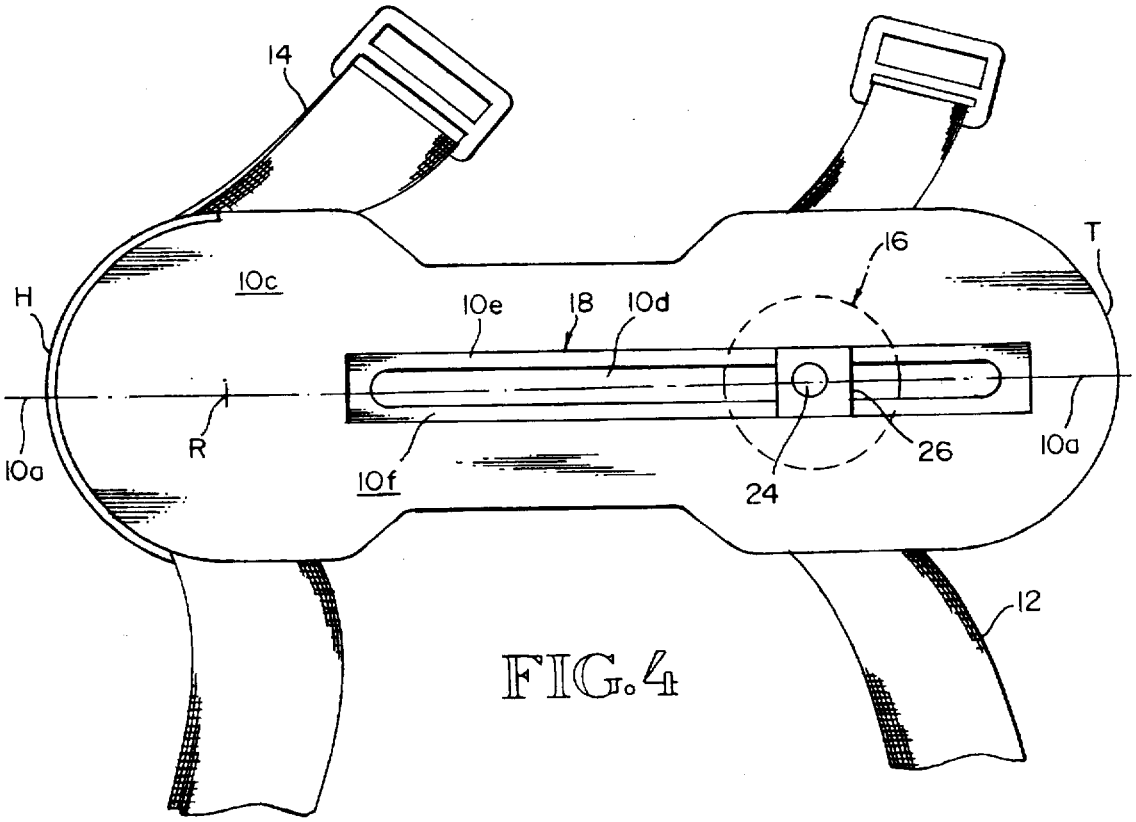
FIG. 4

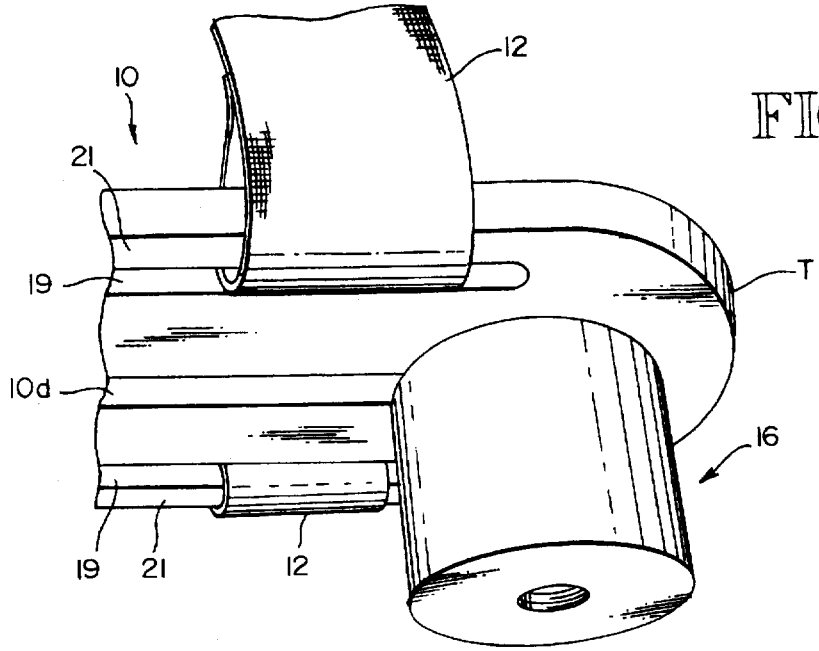
FIG. 7
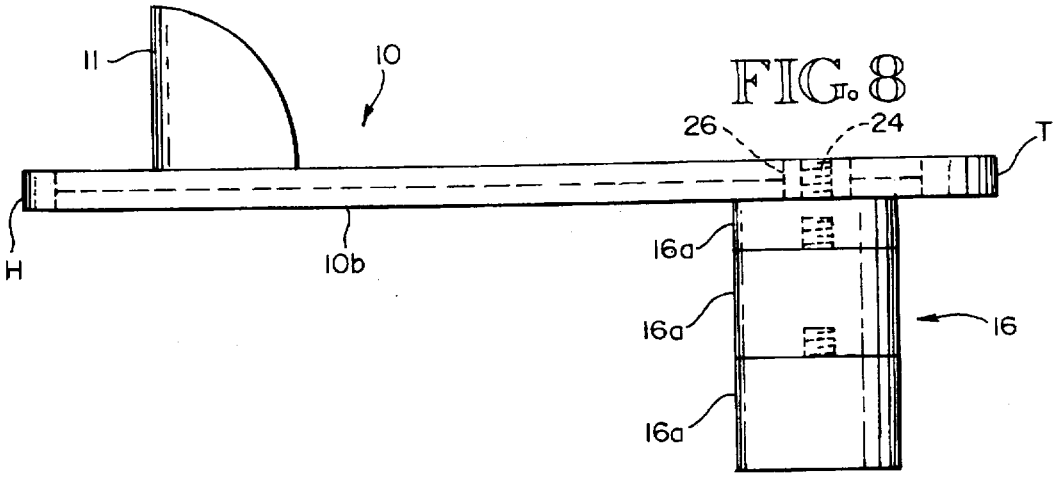
FIG. 8
FIG. 9
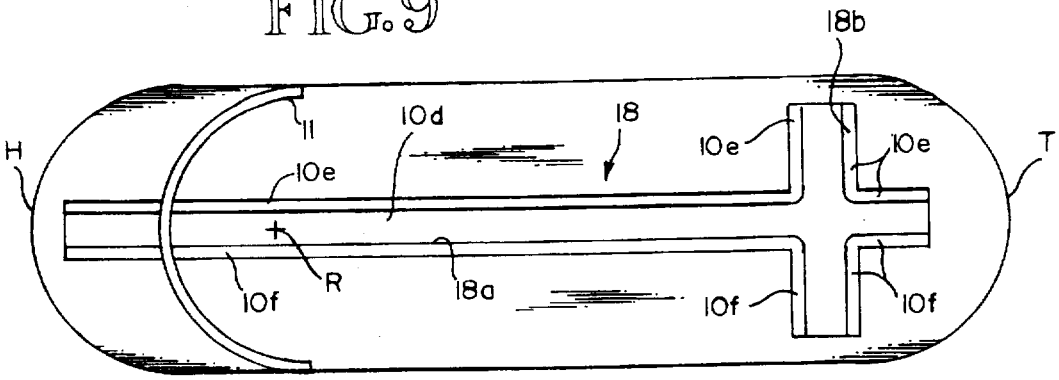

FIG. 10
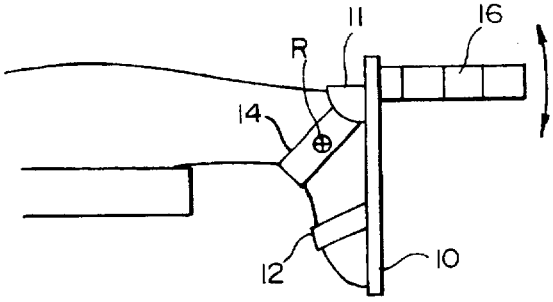
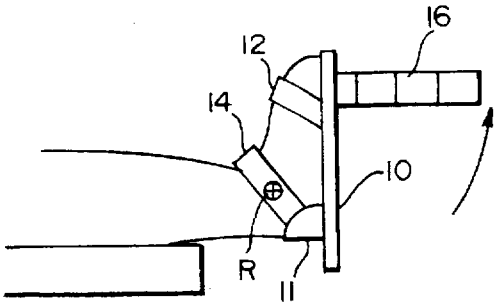
FIG. 11
FIG. 12
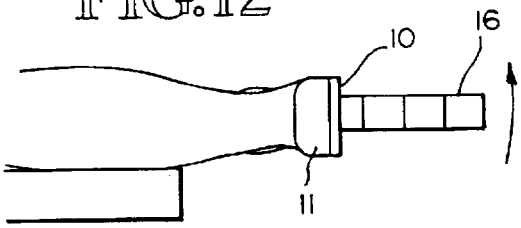
FIG. 13
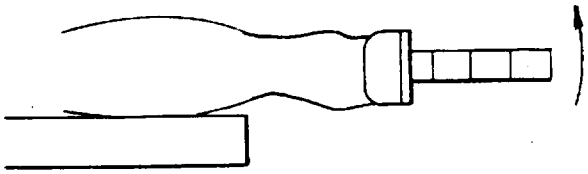
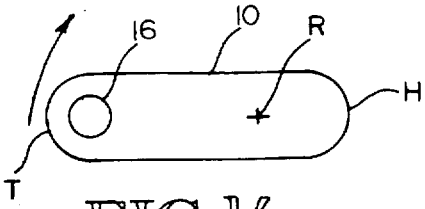
FIG. 14
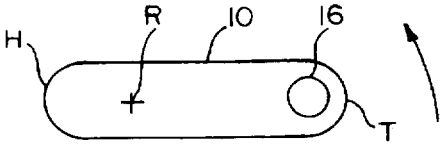
FIG. 15
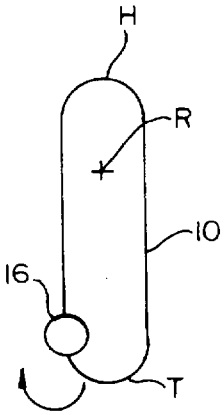
FIG. 16

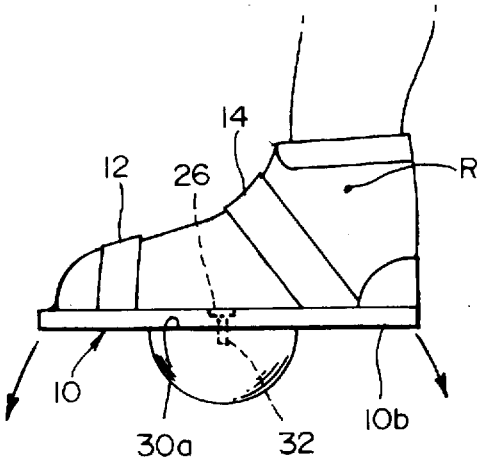
FIG. 24
FIG. 25
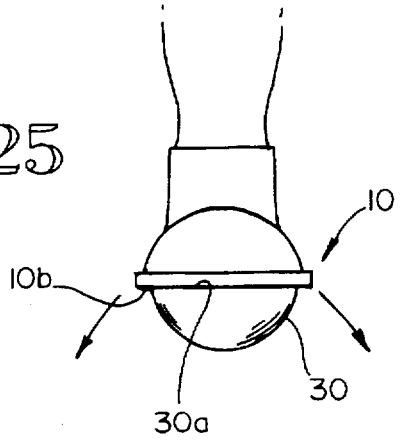

ANKLE REHABILITATION AND CONDITIONING DEVICE

BACKGROUND OF THE INVENTION

1. Field of the Invention

This invention relates to exercising devices and, more particularly, to such devices for exercising and rehabilitating an ankle joint.

2. Brief Description of the Prior Art

Ankle joint exercising devices have been heretofore proposed for the purpose of rehabilitating or conditioning the muscles and tendons associated with the ankle joint. Typically, these devices have involved a weighted shoe-like apparatus designed to be attached to a person's foot so that the person's ankle joint could be maneuvered in different ways against the resistance afforded by the weighted apparatus. The weighted apparatus provides an isotonic resistance load on the ankle muscles and tendons when the ankle is put through various movements. Although such devices serve the purpose of enabling the person's ankle to be moved in various ways against a resistance load so as to effect a strengthening or conditioning of the ankle, many such devices are not adequate to the task of rehabilitating ankles where specific muscles or tendons require strengthening or conditioning. Those devices that are adequate to this task, however, are cumbersome to use and are limited to use in controlled environments under the supervision of a therapist.

SUMMARY OF THE INVENTION

A primary object of this invention is to provide an ankle strengthening and rehabilitating device that is compact, portable and sufficient to enable strengthening and conditioning specific muscles and tendons. Another object of this invention is to provide such a device in which the placement of resistance weights can be conveniently adjusted, both as to position and as to amount of weight. A further object of this invention is to provide such a device that can be used as an ankle strengthening and conditioning device for specific muscles and tendons, but can also be used as a proprioception exercising device to facilitate neuromuscular re-education and increase proprioception and neuromuscular re-education in a damaged or weak ankle. These objects and advantages will become apparent from the following description of the invention.

In accordance with these objects and advantages, the invention comprises an ankle strengthening and rehabilitation device which comprises a foot plate attachable to the sole of a person's foot, and a weight means attachable to the foot plate so as to cantilever outward from the bottom surface of the foot plate. The foot plate may be provided with an isolation channel extending along a longitudinal axis of the foot plate, and with attachment means for attaching the weight means to the foot plate through the isolation channel so that the weight means may be selectively positioned along the longitudinal axis of the foot plate. Alternately, the foot plate may be provided with a series of isolation apertures positioned along a longitudinal axis of the foot plate, and with attachment means for attaching the weight means to the foot plate through any one of isolation apertures so that the weight means may be selectively positioned along the longitudinal axis of the foot plate. The weight means may comprise multiple weighted disks assembled together to form a weighted column. The weight means may be replaced by a proprioception balance element that is adjustably positionable along the longitudinal axis of the foot plate.

BRIEF DESCRIPTION OF THE DRAWINGS

FIG. 1 is a side perspective view of the device of this invention attached to a person's foot;

FIG. 2 is a bottom perspective view of the FIG. 1 device attached to a person's foot;

FIG. 3 is a side perspective view of the top of the FIG. 1 device by itself;

FIG. 4 is a top plan view of the FIG. 3 device;

FIG. 7 is a fragmentary side perspective view of a portion of the bottom of the FIG. 6 embodiment;

FIG. 8 is a side elevation view of still another embodiment of the device of this invention;

FIG. 9 is a top plan view of the FIG. 8 embodiment;

FIG. 10 is a side elevation view of the device of this invention applied to a person's foot that is positioned to exercise the ankle in plantar flexion;

FIG. 11 is a side elevation view of the device of this invention applied to a person's foot that is positioned to exercise the ankle in dorsi flexion;

FIG. 12 is an end elevation view of the device of this invention applied to a person's foot that is positioned with the medial side (inside) up to exercise the ankle in inversion;

FIG. 13 is a side elevation view of the device of this invention applied to a person's foot that is positioned with the lateral side (outside) up to exercise the ankle in eversion;

FIG. 14 is a bottom end elevation view of the device of this invention as applied to a person's foot positioned with the medial side up to exercise the ankle in internal rotation;

FIG. 15 is a bottom end elevation view of the device of this invention as applied to a person's foot positioned with the lateral side up to exercise the ankle in external rotation;

FIG. 16 is a bottom end elevation view of the device of this invention as applied to the foot of a person, lying on his stomach, positioned for a multi-plane posterior tibialis exercise, a combination of plantar flexion, internal rotation and inversion;

FIG. 24 is a side elevation view of the FIGS. 19–20 device applied to a person's foot; and FIG. 25 is an end elevation view of the FIGS. 19–20 device applied to a person's foot.

DESCRIPTION OF THE PREFERRED EMBODIMENT

As seen in the Figures, the device of this invention comprises a rigid foot plate 10 that is provided with foot attachment fasteners such as the toe and ankle straps 12 and 14. The straps 12, 14 may be provided with buckle attachments, with Velcro loop and hook patches, or other means of adjustably securing the straps to a person's foot. The straps may be attached to the foot plate 10 in any suitable manner such as by rivets or by being looped through slots within the foot plate itself. As Shown particularly FIGS. 1 and 2, the device of this invention it typically applied over the shoe worn by the person. Hence, the use of the term "foot" is not meant to imply that the device of this invention must be applied directly to a bare foot; rather the device may be applied to a person's bare foot or covered foot.

Figure 18:
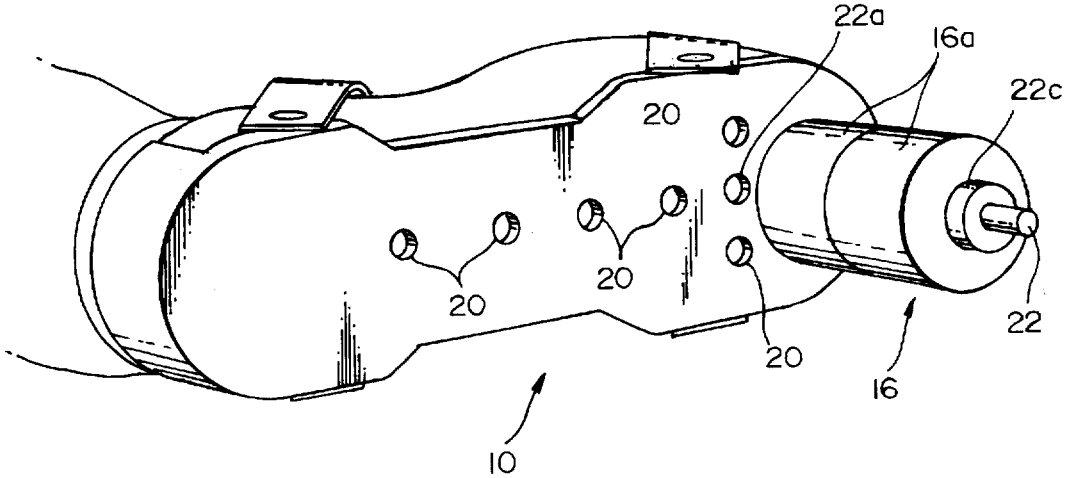
FIG. 18 is still another embodiment of the device of this invention.
Figure 19:
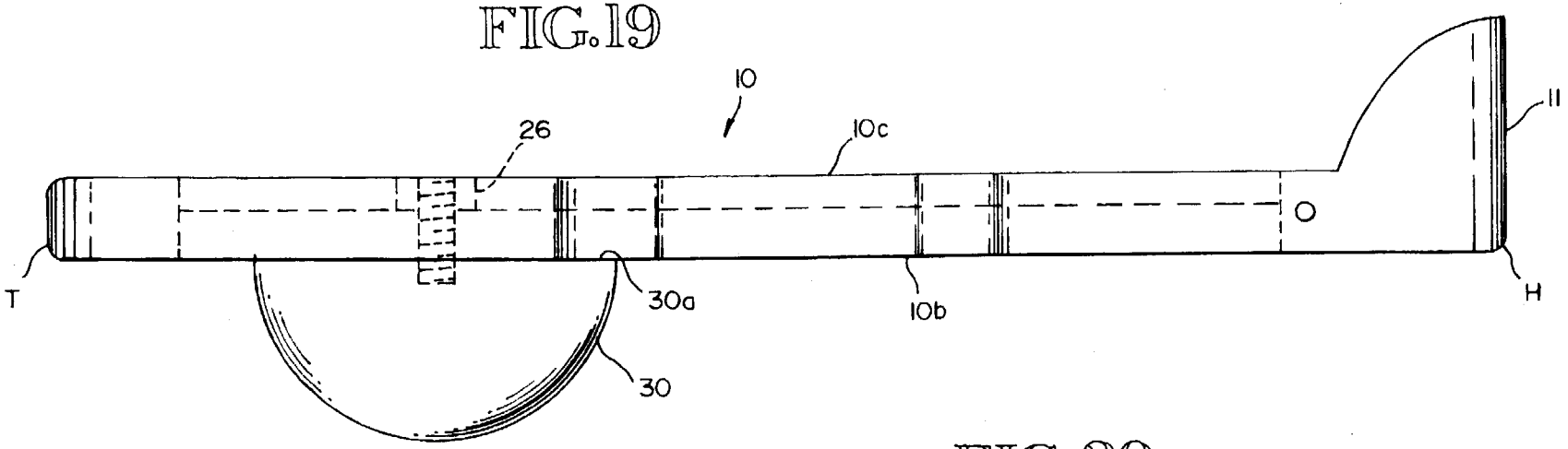
FIG. 19 is a side elevation view of a further embodiment of the device of this invention configured for proprioception exercise.
Figure 20:
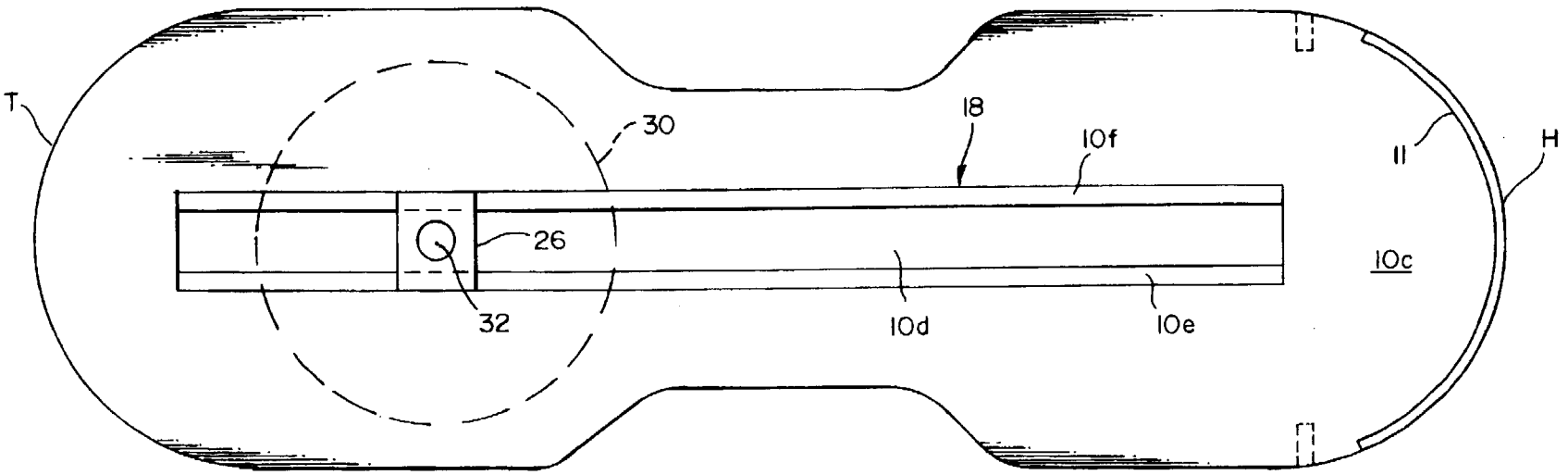
FIG. 20 is a top plane view of the FIG. 17 embodiment.

The device also comprises a weight 16 that is attachable to the foot plate 10 and that is positionable at various locations along the longitudinal axis 10*a* of the foot plate. Weight 16 attaches to the foot plate in a manner such that it will project perpendicularly outward from the bottom surface 10*b* of the foot plate. The foot plate 10 may be provided with an isolation channel 18 (see FIGS. 1–9) that extends longitudinally along the foot plate, and the weight 16 may be adapted to be attached to the foot plate at various locations along the isolation channel. Alternately, the foot plate 10 may be provided with a series of isolation apertures 20 (see FIG. 18), and the weight 16 may be adapted to be attached to the foot plate at any one of the isolation apertures. The isolation channel has at least one portion 18*a* that extends along the longitudinal axis of the foot plate, in the case of the first embodiment. The isolation channel may have a second portion 18*b* that extends perpendicularly transverse to the longitudinal axis of the foot plate. The series of isolation apertures (FIG. 18) is disposed at least along the longitudinal axis of the foot plate, in the case of the second embodiment, approximating the longitudinal channel portion 18*a*. A second series of isolation apertures could be disposed transversely to the longitudinal axis of the foot plate, approximating the location of the transverse channel portion 18*b*. A heel cup 11 may be located on the top of the foot plate 10, extending outward from the foot plate upper or top surface 10*c*, so as to enable the foot plate to be stably attached to the wearer's foot.

The longitudinal channel portion 18*a*, or the longitudinal series of isolation apertures 20, preferably extends at least from a point adjacent to the wearer's axis of ankle rotation, marked by the point R, to a point adjacent to the ball of the wearer's foot. More preferably, the longitudinal extent continues rearward beyond the point R toward the heel H of the foot plate 10, and continues forward beyond the ball of the wearer's foot toward the toe T of the foot plate 10.

The weight 16 may be provided as a series of weighted disks 16*a* that are designed to be assembled together in face-to-face adjacency with the innermost disk adjacent to the bottom surface 10*b* of the foot plate. The weighted disks 16*a* may each be provided with a threaded shaft that protrudes axially from on disk face, and with a threaded bore that extends axially inward from the opposite disk face. This form of weight disk enables the individual disks to be threaded into one another to make up a desired total composite weight. Alternately, the weighted disks 16*a* may each be provided with an axial bore that extends completely through the disk so that the disks might be assembled onto an axial shaft 22 to make up a desired total composite weight. By segmenting the weight 16 into individual weighted disks 16*a*, various total composite weights may be selected as required in any given situation of use of the invention.

In the case of the embodiment employing an isolation channel 18 (FIGS. 1–9), the threaded shaft 24 of the innermost weighted disk 16*a* may be extended through the isolation channel and secured therein by a threaded nut 26 so as to secure the composite weight 16 at that location. Alternately, the axial shaft 22 may be threaded at its innermost end and that end may be extended through the disks and into the isolation channel and secured therein by a threaded nut.

In the case of the embodiment employing a series of isolation apertures (FIG. 18), each isolation aperture may be provided as a threaded bore extending perpendicularly inward from the bottom surface 10*b* of the foot plate. The axial shaft 22 may be threaded at its innermost end and that end may be screwed into one of the threaded apertures to secure the weight at that location. Alternately, where the disks 16*a* are threadedly secured to one another, the threaded shaft 24 of the innermost disk may be screwed into one of the threaded apertures to secure the composite weight 16 at that location.

In either embodiment, the weight 16 is cantilevered perpendicularly outward from the bottom surface 10*b* of the foot plate. Moreover, the foot plate 10 is configured so that its longitudinal axis 10 will underlay the longitudinal axis of a wearer's foot. Therefore, the weight 16 generally will be cantilevered outward and downward at a location along longitudinal axis of the wearer's foot, due to the longitudinal location 18*a* of the isolation channel 18 or the series of isolation apertures 20 on the longitudinal axis. (An exception to this generality is discussed later in this description with respect to a transverse location 18*b* of the isolation channel.) The individual weight disks 16*a* may weigh any desired amount, typically from ¼ lb. to 2 lbs. apiece.

Figure 21:
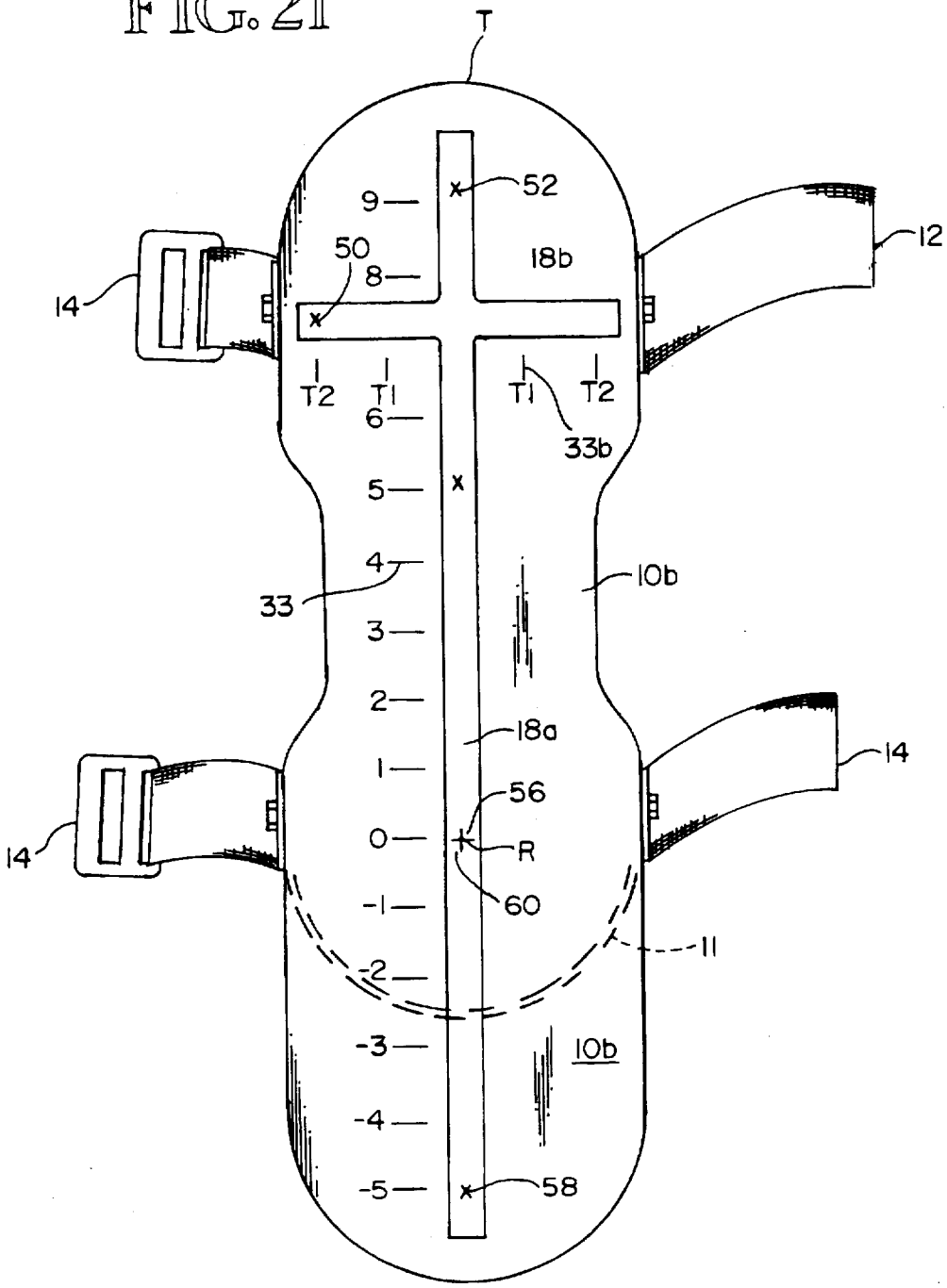
FIG. 21 is a bottom plan view of the FIGS. 8–9 embodiment showing the application of a numerical weight-positioning scale on the underside of the device.
Figure 22:
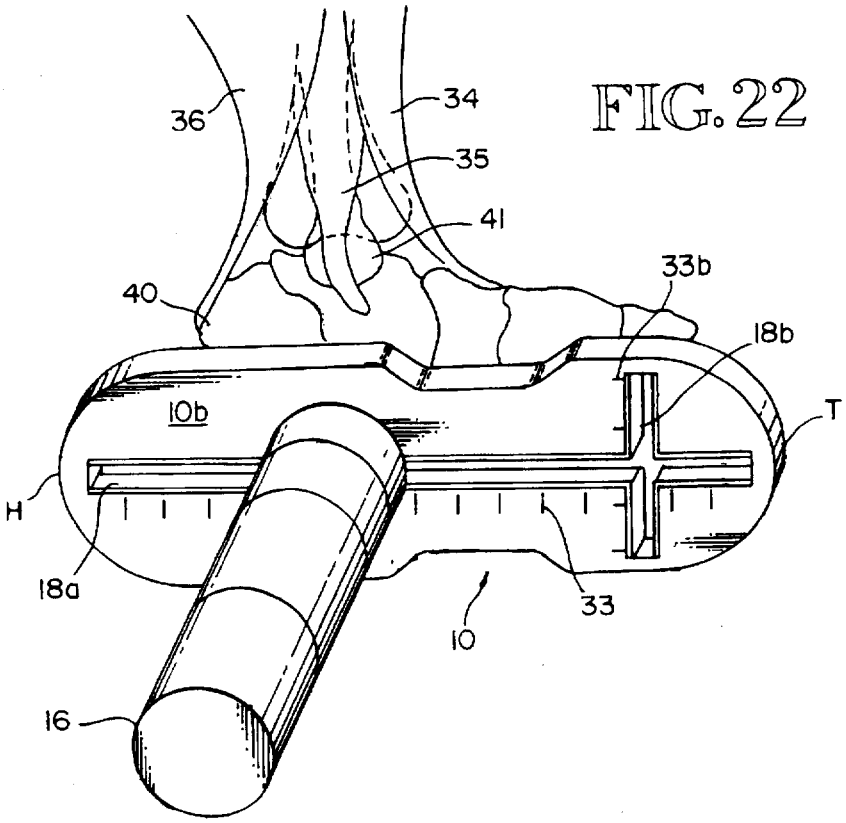
FIG. 22 is a bottom side perspective view of the FIGS. 8–9 embodiment of the device of this invention attached to a person's foot, the foot and ankle being an anatomical view of the skeletal bones and muscles of the lateral side (outside) of the ankle.
Figure 23:
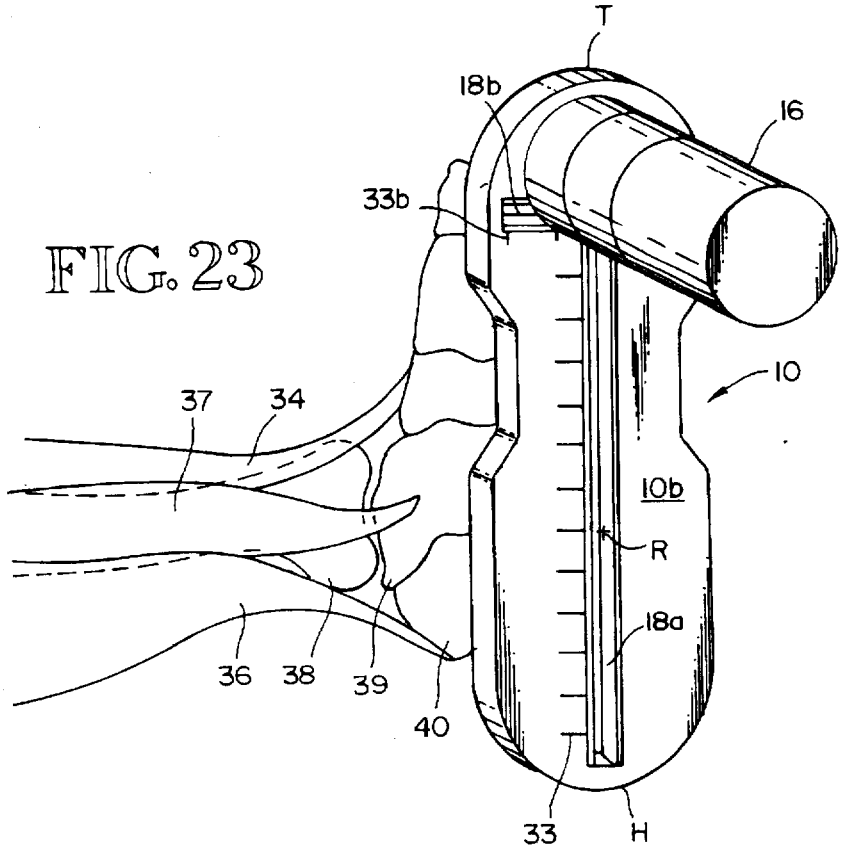
FIG. 23 is a bottom side perspective view of the FIGS. 8–9 embodiment of the device of this invention attached to a person's foot, the foot and ankle being an anatomical view of the skeletal bones and muscles of the medial side (inside) of the ankle.

Proper placement of the weight 16 along the longitudinal axis 10*a* of the foot plate 10 will provide the therapist or wearer with the ability to rehabilitate, stretch, improve proprioception, and strengthen the ankle in ways no other device can accomplish. FIGS. 21–23 illustrate the application of a numerical scale to the bottom of the foot plate 10 that can be employed as an aid in placing the weight 16. The longitudinal isolation channel 18 or longitudinal series of isolation apertures 20, along the longitudinal location 18*a*, will allow the therapist or wearer to: 1) increase the load (resistance) on the stronger muscles that are involved in a multi-plane exercise, yet maintain a constant lighter load (resistance) on the weaker muscles that are involved in the same multi-plane movement, and a workout can be customized to individual needs by varying the amount of resistance on stronger or uninjured muscles simply by changing the placement of the weight stack without compromising the injured or weaker portion of the ankle so as to provide the most efficient and beneficial workout possible; 2) target a problem area by having the ability to place the load (resistance) in the correct biomechanical position to isolate a specific muscle in a single plane exercise; 3) to passively stretch specific muscles without assistance from another individual; and 4) provide consistently decreasing resistance throughout the range of motion while doing single plane plantar flexion. The location of the isolation channel 18 along the transverse location 18*b* will allow the therapist or wearer to: 5) place the resisting force in position to achieve the best possible results for rehabilitating or strengthening the muscles that cause shin splints. This transverse location 18*b* is perpendicularly crosswise to the longitudinal location 18*a* on the section of the foot plate 10 that is approximately adjacent to the ball of the wearer's foot. The numerical scale illustrated in FIG. 21 characterizes weight placement by "0" adjacent the foot's axis or rotation "R", by negative increasing numbers from "0" toward the heel H, by positive increasing numbers from "0" toward the toe T along the longitudinal portion 18*a* of the isolation channel 18, and by $T_1$ and $T_2$ along the transverse portion 18*b* of the isolation channel 18.

With reference to the isolation channel 18 (FIGS. 1–9), the foot plate 10 is provided with an elongated recess which defines the isolation channel 18. The recess preferably is provided as a rectangular slot 10*d* through the foot plate from top to bottom that is bordered by parallel side rims 10*e*, 10*f*. The width of the slot is sufficient to enable a weight disk mounting shaft, such a shaft 22 or shaft 24, to extend into the slot. The side rims 10*e*, 10*f* are recessed below the top surface 10*c* and provide a support ledge for the weight disk mounting shaft nut 26. With this configuration, the top of the nut 26 will not protrude above the foot plate top surface 10*c* and, therefore, the location of the nut 26 within the isolation channel 18 will not interfere with the wearer's foot.

With reference to the series of isolation apertures 20 (FIG. 18), the apertures may be provided as threaded bores into the foot plate 10 or they may be provided by threaded nuts that are mounted to or within the foot plate. These threaded bores will be strategically placed to allow for isolation of specific muscles, tendons, and neuromuscular receptors during both strengthening and proprioceptive exercises. For example the threaded apertures might be located, on the FIG. 21 numerical scale, at numbers 0, 2, 4, 6, 9, $T_1$ and $T_2$. The weight disk mounting shaft 22 may be provided as a dowel 22*a* that is threaded at its inner end 22*b* and that is fitted with a flanged collar 22*c* at its outer end. The collar 22*c* is preferably adjustably positionable along the dowel 22*a* so that one or more weights can be axially clamped between the collar 22*c* and the bottom surface 10*b* of the foot plate to hold the weights securely together. The collar 22*c* can be provided with a set screw that can be loosened to permit the collar to slide along the dowel 22*a*, and that can be tightened against the dowel to lock the collar to the dowel. The apertures 20 are located strategically so that weight disk mounting shaft 22 may be positioned where required for any particular exercise or treatment.

The foot plate 10 may be fabricated from any suitably stiff material, such as aluminum or steel or plastic. The thickness of the foot plate 10 is dependent on the material from which it is fabricated and must be sufficient to insure that it is inflexible. The foot plate may be formed by machining, molding or casting. The material from which it is fabricated must be strong enough to bear the force of the cantilevered weight 16 without deforming or breaking.

Figure 5:
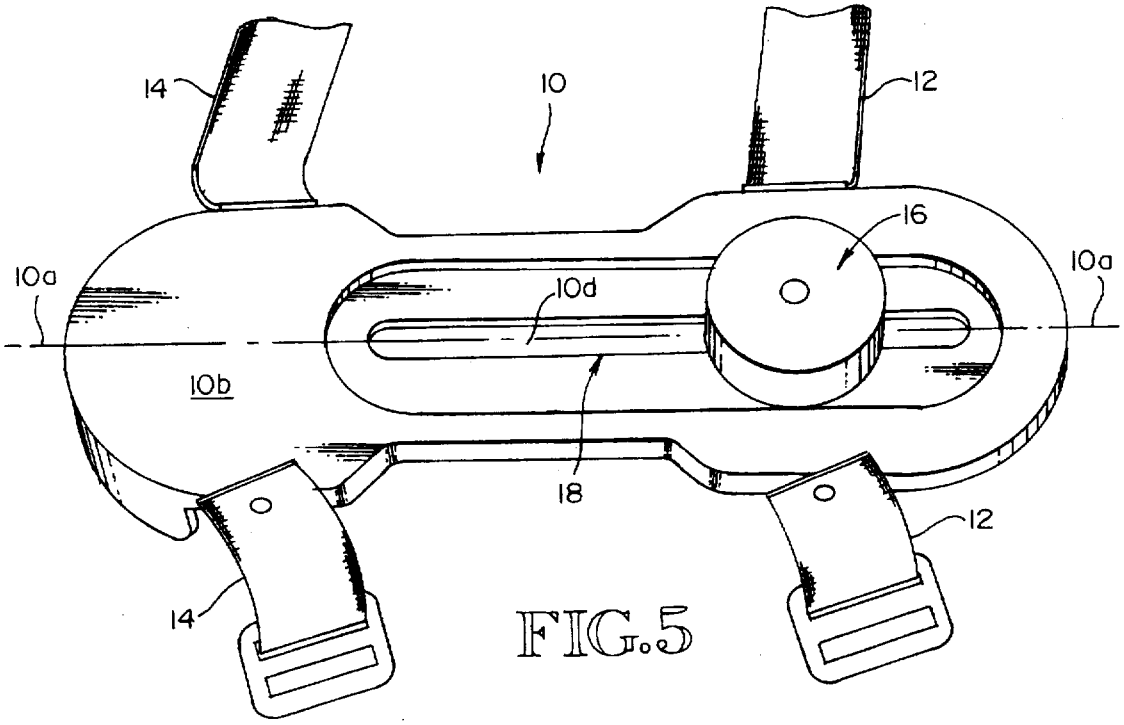
FIG. 5 is a side perspective view of the bottom of the FIG. 1 device by itself.
Figure 6:
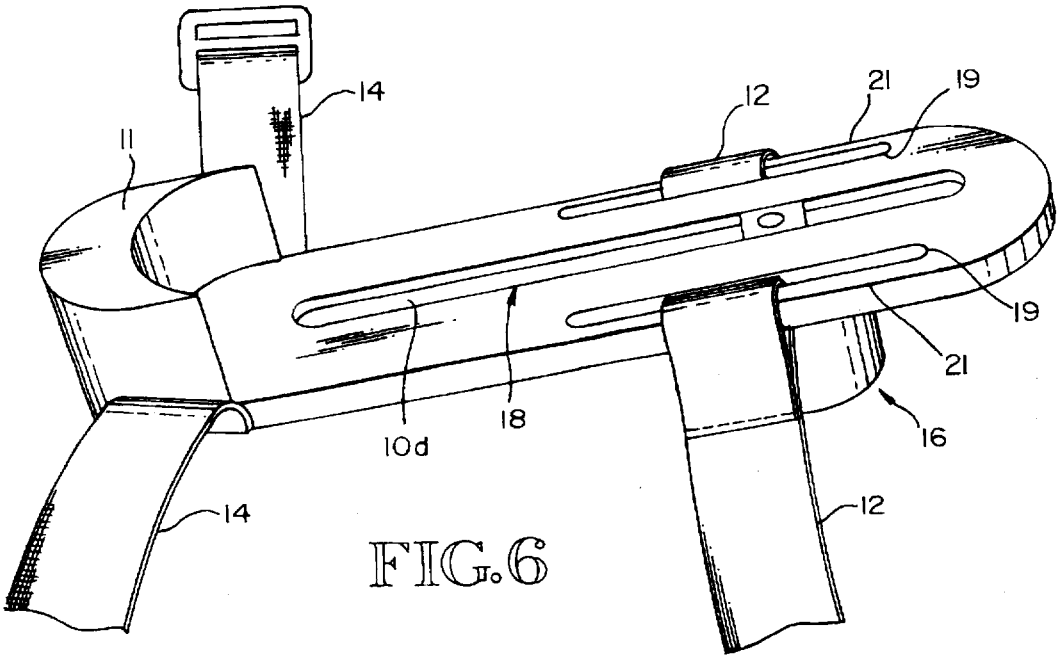
FIG. 6 is a side perspective view of the top of another embodiment of the device of this invention.

FIGS. 1–5 and 8–9 illustrate a suitable configuration for the foot plate 10 if it were formed from metal. FIGS. 6–7 illustrate a suitable configuration for the foot plate 10 if it were formed from plastic. A plastic foot plate might be provided with a heel cup having a thicker cross-section as shown in FIG. 6 for strength purposes. As shown in FIGS. 6 and 7, a plastic foot plate could be molded to provide a pair of longitudinal side slots 19 that define integral side bars 21 around which the toe strap 12 could be extended. These elongated side bars 21 and slots 19 would enable the longitudinal position of the toe strap 12 to be conveniently adjusted to fit any foot size. A metal foot plate could be provided with these side bars 21 and slots 19 also, however that would require the foot plate to be machined as by boring out the slots 19.

The top surface profile of the foot plate may be configured to resemble the sole of a shoe, having a narrower mid-portion and wider heel and toe portions. The weight disks 16*a* may be fabricated from any suitable material such as iron or steel, or they may be fabricated from metal or plastic and filled with metal shot. The weight disk shafts 22 or 24 can be fabricated from any suitable metal or plastic.

The device of this invention will provide isotonic (weighted) resistance to the ankle joint. It will increase the strength of the muscles and tendons that surround the joint, increase range of motion, and at the same time improving proprioception. It is also very effective in the rehabilitation of shin splints.

The ankle is a complex joint that is capable of moving in multiple planes. This device allows an individual to simulate these very movements. The wearer can independently condition or strengthen the ankle in all of its singular planes of movement: plantar flexion; dorsi flexion, inversion, eversion, internal rotation, external rotation. It can also simulate the vast combinations of multiple plane movements that the ankle is often called upon to perform.

Once the amount of weight to be used is determined, this weight can be secured together as a series or stack to produce the desired mechanical disadvantage. This mechanical disadvantage is accomplished by having excess mass at the end of a long lever, which multiplies the actual weight. This mechanical disadvantage will easily produce enough resistance to fatigue the strong ankle muscles.

The strengthening exercises employed with this device are open chain, that is, non-weight bearing, unlike closed chain exercises where the foot of rehab apparatus is in contact with the ground. Employing open chain exercises will allow for rehabilitation at an earlier stage in recovery from an ankle injury. Once a patient straps on the foot plate on his or her foot, the patient will hang that foot off the edge of a table to perform these exercises. By lying on the back, sides or stomach, the patient can exercise the appropriate muscles and tendons simply by performing single- or multi-plane movements of the ankle.

The isolation channel 18 (or the series of isolation apertures 20) permits securing the composite weight 16 in various positions on the foot plate 10. Proper placement of the weight 16 along the longitudinal axis 10*a* of the foot plate (or transversely thereto in the transverse portion 18*b*) will provide the therapist or patient with the ability to rehabilitate, stretch, manipulate, improve proprioception, and strengthen the ankle in ways no other device can accomplish.

The further offset the weight 16 is placed from the axis of ankle rotation R along the isolation channel longitudinal portion 18*a*, when that channel portion is oriented horizontally and parallel to gravitational pull, the more stress there is placed on the stabilizing muscle groups opposite that offset. In effect, a more intense isometric contraction is required by the opposite stabilizer muscles to neutralize the off set load, all while only having a very limited affect on the reduced load placed on the weaker agonist muscle groups (such as the invertors or evertors). This is possible because the length of the moment arm of the resistive force stays constant in all numerical positions of the longitudinally ;channel. Thus, the resistive torque of the agonist (i.e. primary movers) muscle group is not affected.

Whether the longitudinal portion 18*a* of the isolation channel is oriented vertically or horizontally to gravitational pull, the further offset the weight 16 is placed from the axis of ankle rotation R along portion 18*a*, the more stress there can be applied on the stabilizing and/or primary muscle movers to either keep or return the weight 16 directly in line with the rotation axis R. This variable placement will give the therapist or patient the ability to provide accommodating stress on the different areas of the ankle in accordance with the patient's limitations.

Whether the longitudinal portion 18*a* is oriented perpendicular or parallel to gravitational pull, the weight 16 can be located along the channel so that the weight is placed in correct biomechanical position to isolate a specific muscle group in a single-plane exercise. When a load is placed within the isolation channel and aligned directly below an elongated muscle that is then contracted (shortened), it will allow for isolation of that muscle group in the purest form. The muscle group that is directly superior (above) the load becomes the singular (isolated) mover of that mass. The surrounding musculature's role is limited to stabilization. Again, this channel will allow therapists or patients to target a certain problem area of the ankle.

A weak posterior tibialis muscle, which is the single biggest cause of shin splints, is strengthened most effectively when the patient performs plantar flexion, inversion and internal rotation together in a multiplane pattern. To provide maximal stress to the posterior tibialis muscle, the best biomechanical placement of the resisting load is offset to the medial and distal portion of the footplate ($T_2$ on the numerical scale). This moveable offset load will also allow for variations in the amount of resistance that is required to perform the multiple-plane movements the posterior tibialis executes. By locating the weight 16 at various positions along the transverse portion 18*b* of the isolation channel, this medial side offset can be accomplished. This medial placement will allow positioning of the weight to provide maximum stress on the posterior tibialis muscle.

By placing the weight 16 in the same isolated position that strengthens a specific muscle, one can also achieve an effective passive stretch without outside assistance simply by relaxing and allowing that muscle to be elongated (lengthened) and stretched by the adjustable gravitational pull of the weight.

The extended heel beyond the axis R allows for decreasing resistance through the range of motion while doing single-plane plantar flexion, this device will allow for more effective therapy for patients with achilles tendon ruptures. By placing the weighted mass in the −5 position on the numerical scale, when the patient lies on his stomach and plantar flexes, the extended heel allows the weight to move closer in line with the axis of rotation, thus decreasing the moment arm of resisting torque. This ever decreasing moment arm produces a decreased resistive torque as the patient progresses further into plantar flexion. The decreasing resistance will accommodate individuals that cannot do traditional plantar flexion exercises that increase resistance as one gets further into plantar flexion (i.e. more on the toes).

FIGS. 10 to 16 illustrate application of the device of this invention for accomplishing various single- and multi-plane exercise movements. In these Figures, the direction of movement of the device relative to the ankle axis of rotation R to effect the desired exercise movement is indicated by the curved solid arrow. FIG. 10 illustrates the position for plantar flexion, the wearer lying on his or her stomach. FIG. 11 illustrates to position for dorsi flexion, the wearer lying on his or her back. FIG. 12 illustrates to position for inversion, the wearer lying on his or her side with the inside of the leg up. FIG. 13 illustrates the position for eversion, the wearer lying on his or her side with the outside of the leg up. FIG. 14 illustrates to position for internal rotation, the wearer lying on his or her side with the inside of the foot up. FIG. 15 illustrates to position for external rotation, the wearer lying on his or her side with the outside of the foot up.

Figure 17:
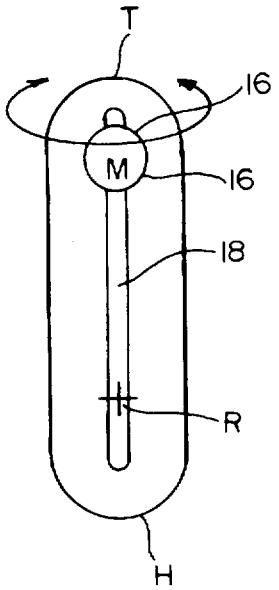
FIG. 17 is a bottom end elevation view of the device of this invention as applied to a person's foot positioned for another form of multi-plane exercise.

All of the foregoing single-plane movements may be combined together in various ways to produce a variety of multi-plane movements which simulate realistic ankle movement. For example, FIG. 16 illustrates the position for posterior tibialis exercise where the movement is a combination of plantar flexion, inversion and internal rotation, the wearer lying on his or her stomach with the weight 16 offset to the inside of the foot. FIG. 17 illustrates another position for multi-plane exercise where the movement is a combination of inversion, eversion, plantar and dorsi flexion, internal and external rotation, the wearer lying on his or her back.

The numerical scale in FIG. 21 can aid in the placement along the isolation channel 18 when conducting various exercises or treatments. Location 50 is indicated as a most effective position of the weight axis to increase strength of the posterior tibialis by movement of the ankle in plantar flexion and inward rotation. Location 52 is indicated of multi-plane or single plane dorsi and plantar flexion on a healthy ankle as a preventative exercise inasmuch as this location produces the maximum mechanical disadvantage. Location 54 is indicated for inversion or eversion with internal or external rotation; the more weight is offset from of the axis of ankle rotation, the more stress is placed on the stronger rotation muscles. Location 56 is indicated for plantar and dorsi flexion with sub-acute medial or lateral ligament damage inasmuch as close placement to the axis of ankle rotation will produce the least amount of stress on weak or damage ligaments and tendons. Location 58 is indicated for achilles tendon rupture inasmuch as the least amount of stress on the tendon during plantar flexion unloads the tendon and allows a consistent decreased resistance through the range of motion. Location 60 is indicated for isolation of inversion or eversion muscles with no internal or external rotation, where the weight is aligned directly below the targeted muscles.

In addition to the use of the foot plate 10 with the cantilevered weight 16 for strengthening ankle muscles and tendons, the foot plate 10 can be used in conjunction with a balance fulcrum, such as a semi-spherical ball 30 (see FIGS. 18–19 and 24–25) in place of weight 16 to increase proprioception. Not only can this combination be employed to duplicate exercises performed on a convention proprioception balance board, but the ball (fulcrum) 30 can be offset from the ankle axis R to various positions along the foot plate to put specific neuromuscular receptor stress on the various areas of the ankle. Offsetting the fulcrum in the transverse portion 18*b* of the isolation channel will allow for precise targeting (stressing) of the neuromuscular receptors of the different areas of the ankle joint during balancing exercises.

Neuromuscular receptors in the skeletal muscles and the surface of the tendons provide constant feedback to the brain regarding movement, posture, changes in equilibrium, and knowledge of position, weight, and resistance against its body parts. This feedback then allows the brain to correct or adapt to these circumstances. The round half-ball 30 is placed on the bottom of the foot plate and the patient stands on it in a closed plane exercise. This ball causes instability (i.e. rocking back and forth of the body in all directions). Neuromuscular receptors detect this rocking and inform the brain of this instability. The brain in return sends a message to the various muscles to contract or relax to correct the instability of the foot plate. This activity trains or re-educates the neuromuscular receptors of the damaged or weak ankle. In this exercise, while standing the patient tries to keep the foot plate from rolling over to the sides, or forward or backward. Unlike traditional balance boards, the isolation channel 18 will allow the ball 30 to be moved to various positions which will enable the therapist or patient to lessen the stress or increase the stress on the involved area of the ankle. Increased distal placement of the ball from axis R will produce more stress on the muscles, tendons and neuromuscular receptors on the opposite side of the ankle joint. These variable placement options will allow for a more productive neuromuscular re-education. The top surface 30*a* of the ball 30 is planar so that it can abut the bottom surface 10*b* of the foot plate 10. A threaded stud 32 extends outward from the coplanar surface of the half-ball 30 and into the isolation channel where it is fastened to the mounting nut 26. Alternately, where the foot plate 10 is provided with a series of isolation apertures 20, the threaded stud 32 may be screwed into one of these apertures to accomplish the purposes of this proprioception exercise.

Following are examples of the application of the device of this invention. These examples should be reviewed with respect to FIGS. 21–23 and the various other Figures specifically references in each example. For the purposes of simplicity, all muscles that move the ankle joint are classified as either invertors 37, evertors 35, plantar flexors 36, or dorsi flexors 34, but like other joints many of these muscles have secondary or limited roles in other movements. They often work as synergists (i.e. muscles that assist indirectly in a movement) with muscles classified in another movement category. The pertinent bone structures are indicated as the tibia bone 38, talus bone 39, calcaneus (heel bone) 40, and fibula 41. The longitudinal channel scale is designated 33 and the transverse channel scale is designated 33*b*.

EXAMPLE 1. Single Plane Inversion (Refer to FIG. 12)

Numerical Position #0

Muscle Group:

- Dorsi Flexors 34 - stabilizers with minimal stress
- Evertors 35 - antagonist muscle group - relaxed
- Plantar Flexors 36 - stabilizers with minimal stress
- Invertors 37 - agonist (primary mover) muscle group - resistance stays constant along longitudinal channel due to consistent length of moment arm of resistive load.

Numerical Position #5

Muscle Group:

- Dorsi Flexors 34 - stabilizers with medium stress
- Evertors 35 - antagonist muscle group - relaxed
- Plantar Flexors 36 - stabilizers with medium stress
- Invertors 37 - agonist (primary mover) muscle group - resistance stays constant along longitudinal channel due to consistent length of moment arm of resistive load.

Numerical Position #9

Muscle Group:

- Dorsi Flexors 34 - stabilizers with maximum stress
- Evertors 35 - antagonist muscle group - relaxed
- Plantar Flexors 36 - stabilizers with maximum stress
- Invertors 37 - agonist (primary mover) muscle group - resistance stays constant along longitudinal channel due to consistent length of moment arm of resistive load.

The length of the moment arm of the resistive load stays constant in all numerical positions of the longitudinal channel, thus not affecting the resistive torque of the agonist muscle group.

EXAMPLE 2. Single Plane Eversion (Refer to FIG. 13)

Numerical Position #0

Muscle Group

- Dorsi Flexors 34 - stabilizers with minimal stress
- Evertors 35 - agonist (primary mover) muscles - resistance stays constant along longitudinal channel
- Plantar Flexors 36 - stabilizers with minimal stress
- Invertors 37 - antagonist muscle group - relaxed.

Numerical Position #5

Muscle Group

- Dorsi Flexors 34 - stabilizers with medium stress
- Evertors 35 - agonist (primary mover) muscles - resistance stays constant along longitudinal channel
- Plantar Flexors 36 - stabilizers with medium stress
- Invertors 37 - antagonist muscle group - relaxed.

Numerical Position #9

Muscle Group

- Dorsi Flexors 34 - stabilizers with maximum stress
- Evertors 35 - agonist (primary mover) muscles - resistance stays constant
- Plantar Flexors 36 - stabilizers with maximum stress
- Invertors 37 - antagonist muscle group - relaxed.

The length of the moment arm of the resistive load stays constant in all numerical positions of the longitudinal channel, thus not affecting the resistive torque of the agonist muscle group.

EXAMPLE 3. Single Plane Dorsi Flexion (Refer to FIG. 11)

Numerical Position #0

Muscle Group

- Dorsi Flexors 34 - agonist (primary mover) minimal resistance
- Evertors 35 - stabilizers with minimal resistance
- Plantar Flexors 36 - antagonist muscle group - relaxed
- Invertors 37 - stabilizers with minimal resistance Numerical Position #5

Muscle Group

- Dorsi Flexors 34 - agonist (primary mover) medium resistance
- Evertors 35 - stabilizers with medium resistance
- Plantar Flexors 36 - antagonist muscle group - relaxed
- Invertors 37 - stabilizers with medium resistance Numerical Position #9

Muscle Group

- Dorsi Flexors 34 - agonist (primary mover) maximal resistance
- Evertors 35 - stabilizers with maximal resistance
- Plantar Flexors 36 - antagonist muscle group - relaxed
- Invertors 37 - stabilizers with maximal resistance EXAMPLE 4. Single Plane Plantar Flexion while lying on stomach (Refer to FIG. 10)

Numerical Position #0

Muscle Groups

Dorsi Flexors 34 - antagonist muscle group - relaxed
Evertors 35 - stabilizers with minimal stress
Plantar Flexors 36 agonist (primary mover-minimal resistance
Invertors 37 - stabilizers with minimal stress Numerical Position #9

Muscle Groups
Dorsi Flexors 34 - antagonist muscle group - relaxed
Evertors 35 - stabilizers with maximum stress
Plantar Flexors 36 agonist (primary mover-maximum resistance
Invertors 37 - stabilizers with maximum stress Numerical Position #–5

Muscle Groups
Dorsi Flexors 34 - antagonist muscle group - relaxed
Evertors 35 - stabilizers with medium resistance
Plantar Flexors 36 agonist (primary mover-minimal resistance that continues to decrease with increased plantar flexion due to ever decreasing moment arm of resistive load
Invertors 37 - stabilizers with medium stress Increased plantar flexion results in a decreasing moment arm of resisting force. This ever decreasing moment arm allows for decreasing resistive torque as the patient progresses further into plantar flexion.

EXAMPLE 5. Posterior Tibialis Exercises (Refer to FIG. 16)

Numerical Position #$T_1$

Muscle Group
Dorsi Flexors 34 - stabilizers with medium to maximal stress
Evertors 35 - antagonist muscle group - relaxed
Plantar Flexors 36 - agonist (co-primary mover) - medium stress
Invertors 37 - agonist (co-primary mover) - medium stress Numerical Position #$T_2$ Muscle Group
Dorsi Flexors 34 - stabilizers with medium to maximal stress
Evertors 35 - antagonist muscle group - relaxed
Plantar Flexors 36 - agonist (co-primary mover) - maximal stress
Invertors 37 - agonist (co-primary mover) - maximal stress By offsetting the weight to $T_2$ in the transverse channel the length of the moment arm of the resistive load is increased; 1 increasing the resistive torque on the tibialis anterior while performing multiplane plantar flexion, inversion, and internal rotation (adduction).

While the preferred embodiment of the invention has been described herein, variations in the design may be made. For example, the weight disk shafts 22 or 24 could be employed as hand grips used by a therapist to manipulate an ankle during a rehabilitation procedure. The scope of the invention, therefore, is only to be limited by the claims appended hereto.

The embodiments of the invention in which an exclusive property is claimed are defined as follows:

1. An ankle strengthening and rehabilitation device which comprises a foot plate provided with an isolation channel having a longitudinal portion extending along a longitudinal axis of said foot plate and a transverse portion extending along a transverse axis transverse to said longitudinal axis; a weight; and a fastener connecting said weight to said foot plate through said isolation channel so that said weight cantilevers outward from a bottom surface of said foot plate and so that said weight may be selectively positioned along said longitudinal axis and said transverse axis and secured in a selected position and a means for attaching the foot plate to a person's foot.

2. The device of claim 1 wherein said isolation channel is provided as a slot extending through said foot plate, said slot being bounded by a recessed peripheral rim; and wherein said fastener is set within and adapted to slide along said recessed peripheral rim.

3. The device of claim 2 wherein said weight comprises multiple weighted disks assembled together to form a weighted column.

4. The device of claim 2 wherein said weight comprises a columnar weight; and wherein said fastener comprises (i) a nut set within said slot and (ii) a threaded shank screwed into said nut that extends out through said slot and connects to said weight so that said nut may be loosened and tightened by turning said weight.

5. The device of claim 1 wherein said weight comprises multiple weighted disks assembled together to form a weighted column.

6. An ankle strengthening and rehabilitation device which comprises a foot plate provided with a series of isolation apertures having a longitudinal portion positioned along a longitudinal axis of said foot plate and a transverse portion positioned along a transverse axis transverse to said longitudinal axis a means for attaching the foot plate to a person's foot; a weight; and a fastener connecting said weight to said foot plate through any one of said isolation apertures so that said weight cantilevers outward from a bottom surface of said foot plate and so that said weight may be selectively positioned along said longitudinal axis and said transverse axis and secured in a selected position.

7. The device of claim 6 wherein said weight comprises multiple weighted disks assembled together to form a weighted column.

8. An ankle strengthening and rehabilitation device which comprises a foot plate having a top surface and a bottom surface, said foot plate being provided with an isolation channel extending along a longitudinal axis of said foot plate, said isolation channel providing an elongated slot within said foot plate aligned with said longitudinal axis, said slot having a bottom opening at the bottom surface of said foot plate and having a stepped configuration so as to provide a rim recessed from the top surface; fastener means that rides in said isolation channel and bears against the recessed rim for connecting an exercise object to said foot plate so that the exercise object cantilevers outward from the bottom surface of said foot plate and so that the exercise object may be selectively positioned along said longitudinal axis and secured to said foot plate in a selected position; and means on said exercise object for engaging said fastener, said fastener means and said engaging means being cooperatively constructed and arranged such that the exercise object is clamped to the bottom surface of said foot plate when related with respect to said foot plate.

9. The device of claim 8 wherein said foot plate includes a heel piece for locating a user's heel on said top surface; and wherein said foot plate extends rearwardly of said heel piece so that said bottom surface and said isolation channel extend both extend beneath and rearwardly of said heel piece so that the exercise object can be positioned beneath said heel piece and rearwardly of said heel piece.

10. The device of claim 9 wherein said exercise object comprises multiple weighted disks assembled together to form a weighted column.

11. The device of claim 8 wherein said exercise object comprises multiple weighted disks assembled together to form a weighted column.

12. The device of claim 8 wherein said exercise object comprises a proprioception balance element.

13. The device of claim 8 wherein said exercise object comprises a shaft for as a hand grip.

* * * * *